US009117606B2

(12) United States Patent
Chou et al.

(10) Patent No.: US 9,117,606 B2
(45) **Date of Patent: *Aug. 25, 2015**

(54) MULTI-INSTRUCTION SWITCH FOR ENHANCING ELECTRICAL INSULATION

(71) Applicant: ZIPPY TECHNOLOGY CORP., New Taipei (TW)

(72) Inventors: Chin-Wen Chou, New Taipei (TW); King-Long Lee, New Taipei (TW)

(73) Assignee: ZIPPY TECHNOLOGY CORP., New Taipei (TW)

( * ) Notice: Subject to any disclaimer, the term of this patent is extended or adjusted under 35 U.S.C. 154(b) by 73 days.

This patent is subject to a terminal disclaimer.

(21) Appl. No.: 14/165,247

(22) Filed: Jan. 27, 2014

(65) Prior Publication Data

US 2015/0041439 A1 Feb. 12, 2015

Related U.S. Application Data

(63) Continuation-in-part of application No. 13/964,906, filed on Aug. 12, 2013.

(51) Int. Cl.
*H01H 13/36* (2006.01)
*H01H 13/40* (2006.01)
*H01H 33/06* (2006.01)

(52) U.S. Cl.
CPC ..... *H01H 33/06* (2013.01)

(58) Field of Classification Search
CPC ..... H01H 13/40; H01H 13/36; H01H 13/20; H01H 33/06
USPC ..... 200/402, 407–409, 447, 456, 46, 460, 200/451
See application file for complete search history.

(56) References Cited

U.S. PATENT DOCUMENTS

| | | | | |
|---|---|---|---|---|
| 5,459,295 | A * | 10/1995 | Ohta et al. | 200/461 |
| 5,790,010 | A * | 8/1998 | Schwab | 337/365 |
| 5,913,415 | A * | 6/1999 | Kishi et al. | 200/456 |
| 7,232,971 | B2 * | 6/2007 | Chen | 200/460 |
| 2005/0109601 | A1 * | 5/2005 | Collot et al. | 200/402 |
| 2015/0041294 | A1 * | 2/2015 | Lee | 200/293 |

* cited by examiner

*Primary Examiner* — Renee Luebke
*Assistant Examiner* — Ahmed Saeed
(74) *Attorney, Agent, or Firm* — Muncy, Geissler, Olds, and Lowe, P.C.

(57) ABSTRACT

A multi-instruction switch for enhancing electrical insulation is provided. The multi-instruction switch includes a housing, a common pin and a switching pin set. The housing comprises an accommodating space which includes a conductive elastic plate moving back-and-forth and a support rack therein. The conductive elastic plate includes a normal connection section and a switching connection section. The support rack includes a limiting track. The common pin is normally in electrical contact with the normal connection section in the housing. The switching pin set includes a first pin having a contact section and a second pin having a trigger section. The limiting track includes a first insulation plate, a second insulation plate, and an insulation space between the first and second insulation plates. As such, the present invention enhances the insulation effect by the first and second insulation plates and the insulation space located at the limiting track.

11 Claims, 7 Drawing Sheets

MULTI-INSTRUCTION SWITCH FOR ENHANCING ELECTRICAL INSULATION

This application is a continuation-in-part, and claims priority, of from U.S. patent application Ser. No. 13/964,906 filed on Aug. 12, 2013, entitled "MULTI-INSTRUCTION SWITCH FOR ENHANCING ELECTRICAL INSULATION", the entire contents of which are hereby incorporated by reference.

FIELD OF THE INVENTION

The present invention relates to a multi-instruction switch, and particularly to multi-instruction switch capable of enhancing electrical insulation.

BACKGROUND OF THE INVENTION

Along with the miniaturization of various electronic devices, designs of electronic components correspondingly follow the miniaturization trend. FIG. 1 shows a switch element that controls an output signal. Referring to FIG. 1, a conventional switch element includes a switch housing, a common pin 1, an normally closed pin 2 and an normally open pin 3. The switch housing includes an accommodating space, an elastic plate 41 disposed in the accommodating space, and a support rack 42. The support rack 42 has a movement track 421 for the elastic plate 41 to move therein, and an insulation block 422 disposed in the movement track 421. The common pin 1 penetrates through the switch housing to extend into the accommodating space 41 to become electrically in contact with the elastic plate 41. The normally closed pin 2 is partially embedded in the support rack 42, and extends into the movement track 421 to abut against one side of the simulation block 421. The normally open pin 3 penetrates through the switch housing and is exposed in the movement track 421, with an exposed part abutting against the opposite side to the side abutted against by the normally closed pin 2. When the elastic plate 41 is pressed by an external force and thus moves in the movement track 421, the elastic plate 41, from the normally closed pin 2 originally in contact with, crosses the insulation block 422 to become in contact with the normally open pin 3.

As the conductive elastic plate 41 comes into contact with the normally closed pin 2 or the normally open pin 3 during up-and-down movements, a contact point is melted by an electric arc as a result of electric discharge. Thus, carbon residue is generated and scattered to the surroundings and even deposited on the insulation block 422. With long-term accumulation, the carbon residue forms a conductive layer that connects the normally closed pin 2 to the normally open pin 3. During a high-voltage test, the conductive layer electrically connects the normally closed pin 2 to the normally open pin 3 in a way that, the micro-switch not only becomes malfunctioning but also fails safety certification of higher amperage and an expected product yield rate.

SUMMARY OF THE INVENTION

Therefore the primary object of the present invention is to overcome the above issue of a switch malfunction caused by deposited carbon residue at an insulation block in a conventional switch structure.

To achieve the above object, a multi-instruction switch for enhancing electrical insulation is provided. The multi-instruction switch comprises a housing, a common pin, and a switching pin set. The housing comprises an accommodating space, a conductive elastic plate performing a back-and-forth press process when receiving a user press, and a support rack disposed in the accommodating space. The conductive elastic plate comprises a normal connection section and a switching connection section. The support rack has a limiting track for the switching connection section to move therein. The common pin penetrates through the housing to extend into the accommodating space, and is normally in electrical contact with the normal connection section. The switching pin set, penetrating through the housing to extend into the accommodating space, comprises a first pin and a second pin disposed on the support rack. The first pin comprises a contact section located in the limiting track. The second pin comprises a trigger section located in the limiting track. The limiting track comprises a first insulation plate disposed at the contact section and located between the contact section and the trigger section, a second insulation plate disposed at the trigger section and located between the contact section and the trigger section, and an insulation space located between the first insulation plate and the second insulation plate.

In an embodiment, the support rack comprises a first support portion for fixing the first pin, and a second support portion for fixing the second pin.

In an embodiment, the first support portion comprises a first embedding slot for embedding the first pin; the second support portion is disposed correspondingly to the first embedding slot and is for embedding the second pin.

In an embodiment, the second support portion comprises an engaging slot for fixing the second pin.

In an embodiment, the first pin has a connection section embedded in the first support portion and connected to the contact portion.

In an embodiment, the first insulation plate is connected to the first support portion and the second support portion, and the second insulation plate is connected to the first support portion and the second support portion.

In an embodiment, the thickness of the first insulation plate is greater than the thickness of the contact section, and the thickness of the second insulation plate is greater than the thickness of the trigger section.

In an embodiment, the housing is formed by a base and a cover.

In an embodiment, the housing further comprises a press member assembled with the conductive elastic plate.

In an embodiment, the press member comprises a flexible support member that deforms when receiving a user press during the back-and-forth press operation.

In an embodiment, the housing further comprises a restoration spring disposed in the accommodating space, accommodating around the common pin and connected to the conductive elastic plate.

Compared to a conventional multi-instruction switch structure, the multi-instruction switch of the present invention has the features below.

In the multi-instruction switch for enhancing electrical insulation of to the present invention, an insulation effect is enhanced through the first insulation plate, the second insulation plate and the insulation space located at the limiting track. The first insulation plate and the second insulation plate are capable of cutting off unnecessary contact between the conductive elastic plate and the switching pin set. The insulation space prevents the carbon residue deposit, which is generated during the switching process of the conductive elastic plate, from indirectly conducting the contact section and the trigger section to thus eliminate the issue of a switch malfunction. Therefore, the present invention effectively enhances the electrical insulation capability of the switch.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
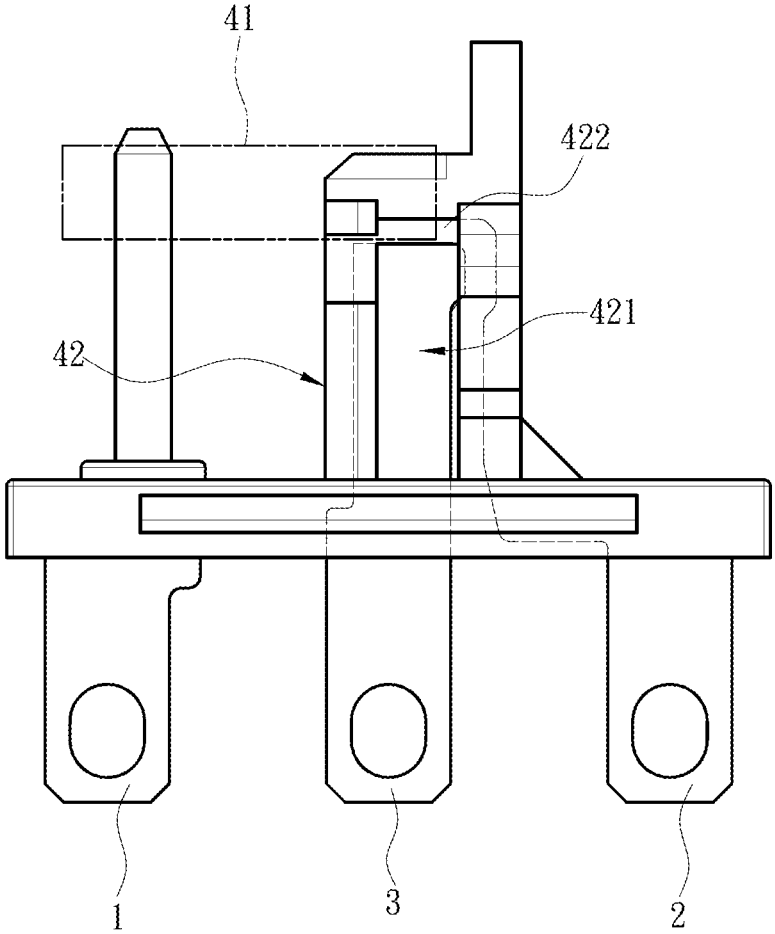
Fig. 1 PRIOR ART
FIG. 1 is a partial schematic diagram of a conventional switch structure.
Figure 2:
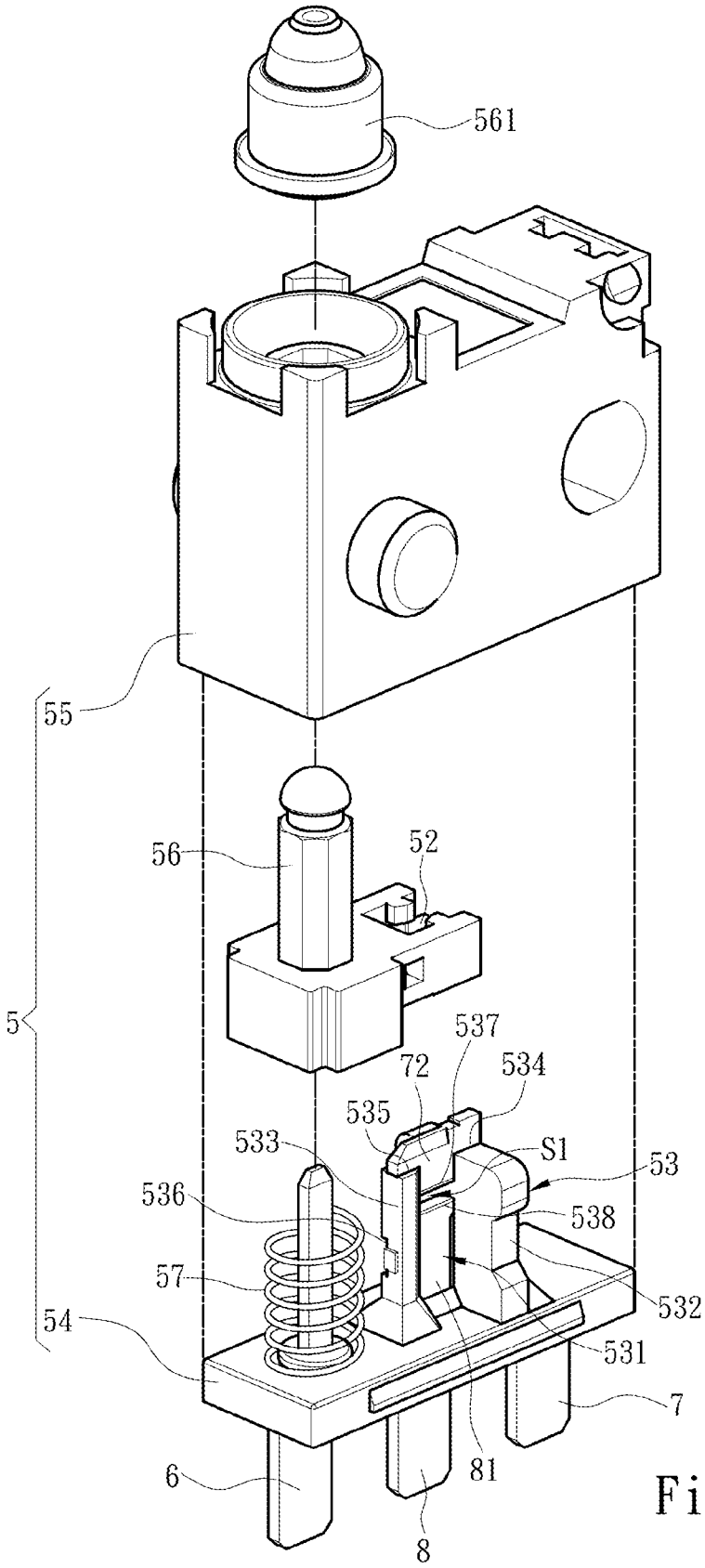
FIG. 2 is an exploded view of a multi-instruction switch for enhancing electrical insulation of the present invention.
Figure 3:
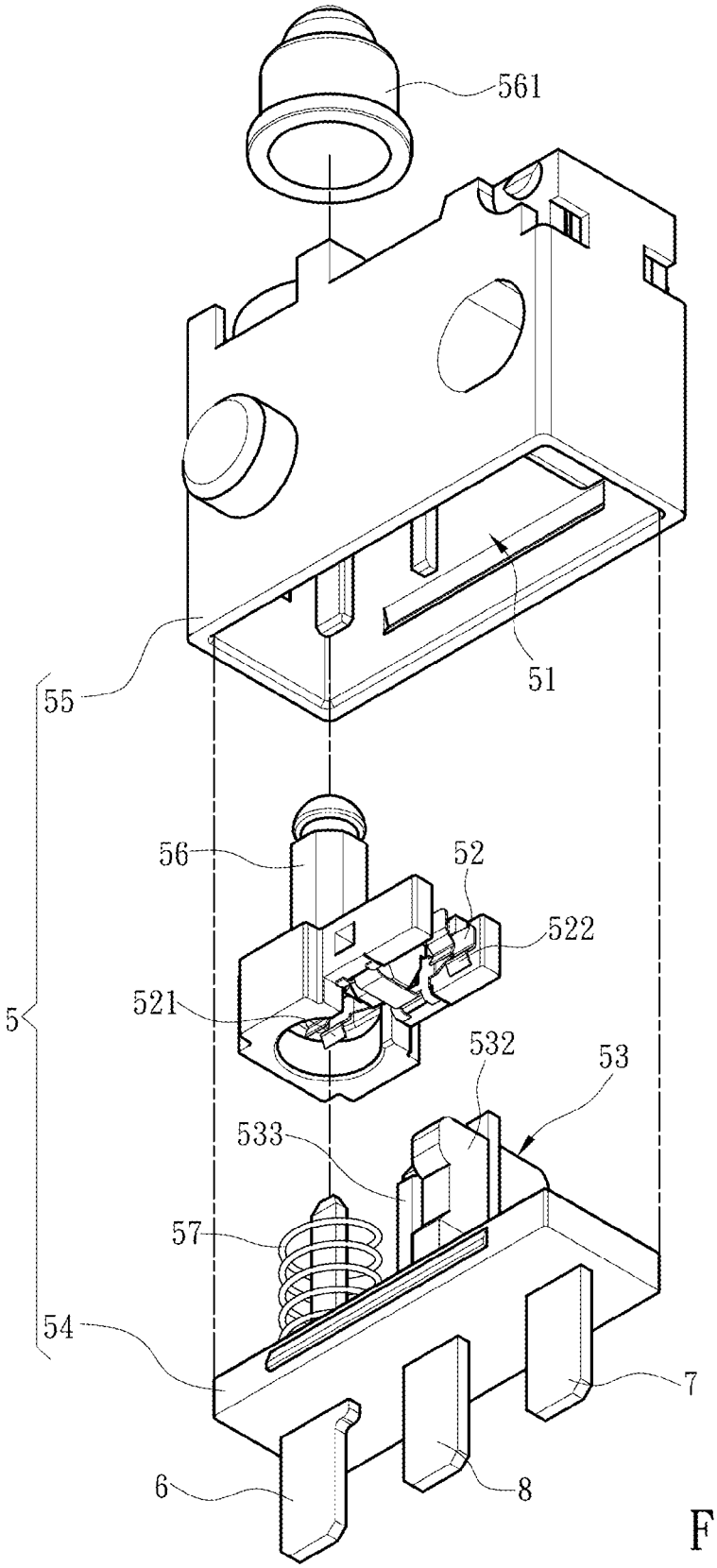
FIG. 3 is another exploded view of a multi-instruction switch for enhancing electrical insulation of the present invention.
Figure 4:
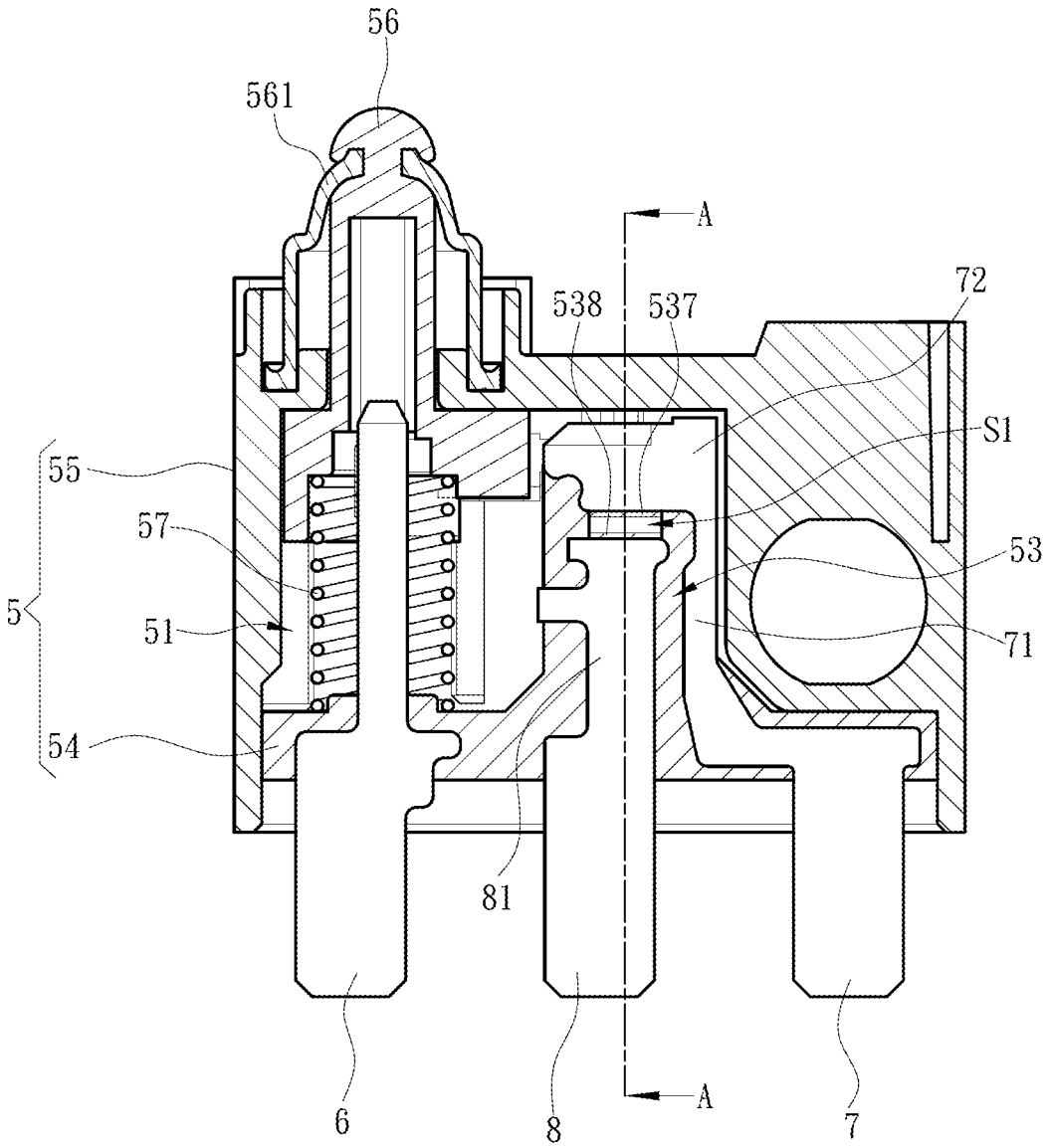
FIG. 4 is a sectional view of a multi-instruction switch for enhancing electrical insulation of the present invention.

A multi-instruction switch for enhancing electrical insulation of the present invention can be implemented in various embodiments according to the different application requirements. Current multi-instruction switches usually comprise at least two pins for switching and outputting different instructions. In the present invention, a multi-instruction switch comprising three pin is taken as an example for explaining the embodiment, not limiting the present invention.

Referring to FIGS. 2 to 4, FIG. 6 and FIG. 7, a multi-instruction switch for enhancing electrical insulation comprises a housing 5, a common pin 6, and a switching pin set having a first pin 7 and a second pin 8. The housing 5 is hollow for forming an accommodating space 51, and comprises a conductive elastic plate 52 and a support rack 53. The conductive elastic plate 52 is disposed in the accommodating space 51, and is movable when receiving an external force. The support rack 53 is connected to the housing 5 and is disposed in the accommodating space 51. More specifically, the housing 5 may be formed by assembling a base 54 and a cover 55. The conductive elastic plate 52 comprises a normal connection section 521, and a switching connection section 522 connected to the normal connection section 521. The support rack 53 extends in an integral from the base 54 to the cover 55, and a position of the support rack 53 corresponding to the switching connection section 522 has a limiting track 531 for the switching connection section 522 to move therein. Further, the support rack 53, corresponding to two sides of the limiting track 531, comprises a first support portion 532 for fixing the first pin 7 and a second support portion 533 for fixing the second pin 8. The first support portion 532 has a first embedding slot 534 for embedding the first pin 7. The second support portion 533 has a second embedding slot 535 disposed correspondingly to the first embedding slot 534 and for embedding the second pin 8, and an engaging slot 536 for fixing the second pin 8. The common pin 6, the first pin 7 and the second pin 8 penetrate through the housing 5 to extend into the accommodating space 51. The common pin 6 is in constant electrical contact with the normal connection section 521 of the conductive elastic plate 52. The first pin 7 comprises a connection section 71 embedded in the first support portion 532, and a contact section 72 extending from the connection section 71 into the limiting track 531 and normally electrically connected to the switching connection section 522. The second pin 8 comprises a trigger section 81 located in the limiting track 531. The limiting track 531 comprises a first insulation plate 538 disposed at the contact section 72 and located between the contact section 72 and the trigger section 81, a second insulation plate 538 disposed at the trigger section 81 and located between the contact section 72 and the trigger section 81, and an insulation space S1 located between the first insulation plate 537 and the second insulation plate 538. In the embodiment, the first insulation plate 537 is connected to the first support portion 532 and the second support portion 533, and the second insulation plate 538 is connected to the first support portion 532 and the second support portion 533. In an alternative embodiment, for example, the first insulation plate 537 and the second insulation plate 538 may be two independent components that are respectively connected to the first support portion 532 and the second support portion 533. The thickness of the first insulation plate 537 is greater than the thickness of the contact section 72, and the thickness of the second insulation plate 533 is greater than the thickness of the trigger section 81. Further, carbon residue generated during the switching process of the conductive elastic plate 52 is prohibited from depositing between the contact section 72 and the trigger section 81, thereby preventing the carbon residue from conducting the contact section 72 and the trigger section 81. The housing 5 further comprises a press member 56 assembled with the conductive elastic plate 52, and a restoration spring 57 disposed in the accommodating space 51 and accommodating around the common pin 6 to connect to the conductive elastic plate 52. The press member 56 further comprises a flexible support member 561 that is deformed when receiving a user press.

Figure 5A:
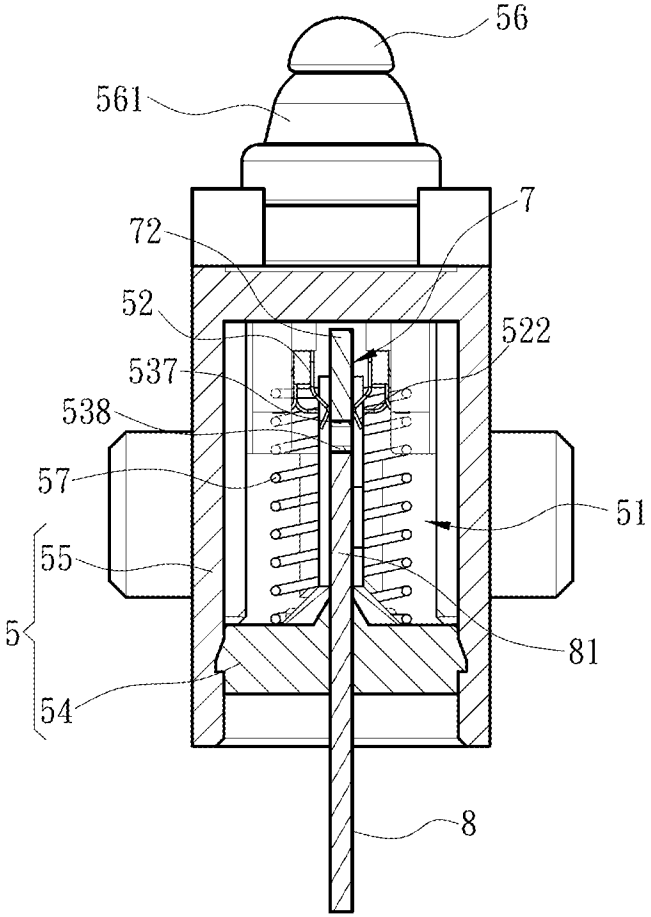
FIG. 5A is a sectional view of a released position along a section line 5A in FIG. 4.
Figure 5B:
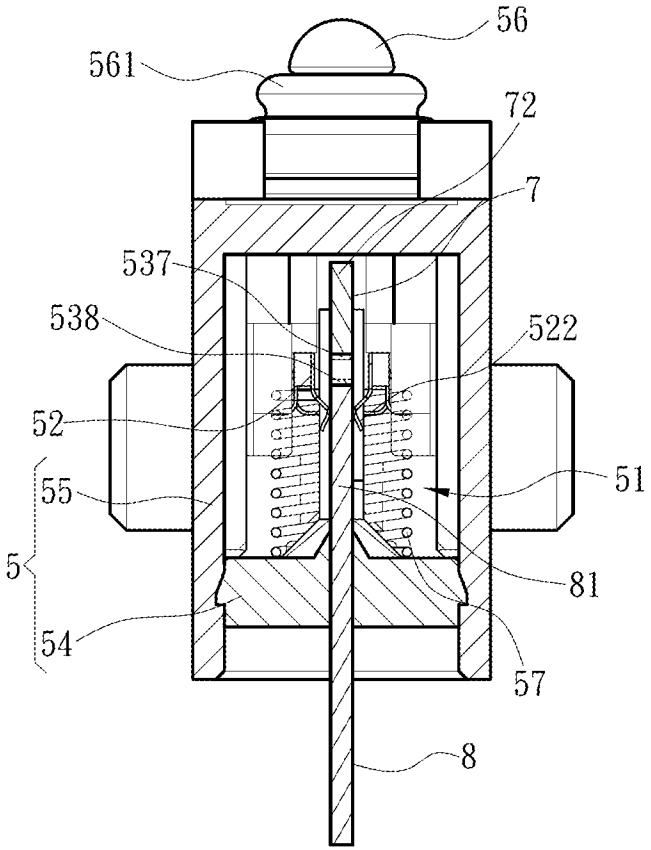
FIG. 5B is a sectional view of a pressed position along a section line 5A in FIG. 4.
Figure 6:
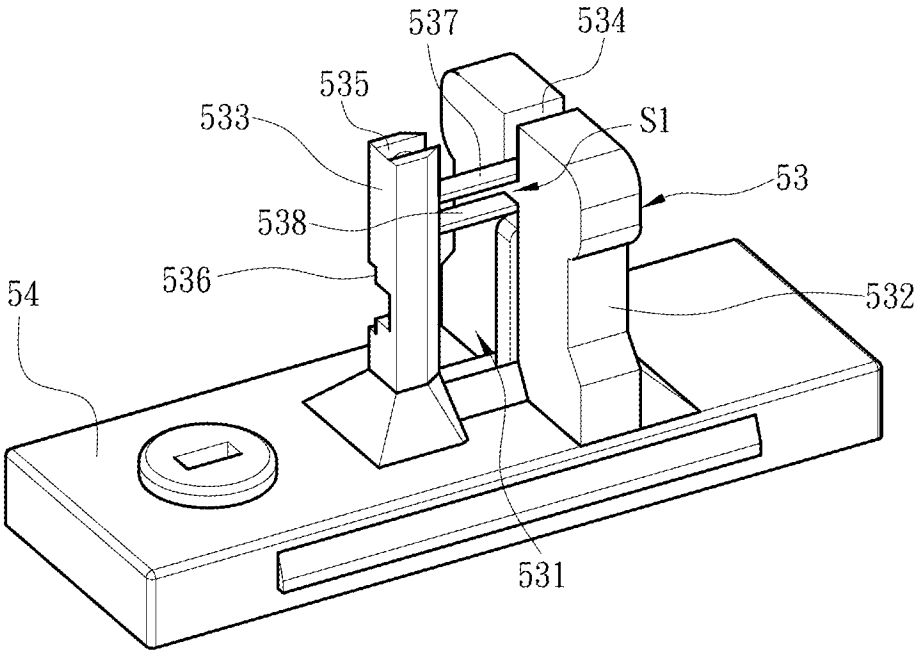
FIG. 6 is a schematic diagram of a base of a multi-instruction switch for enhancing electrical insulation of the present invention.
Figure 7:
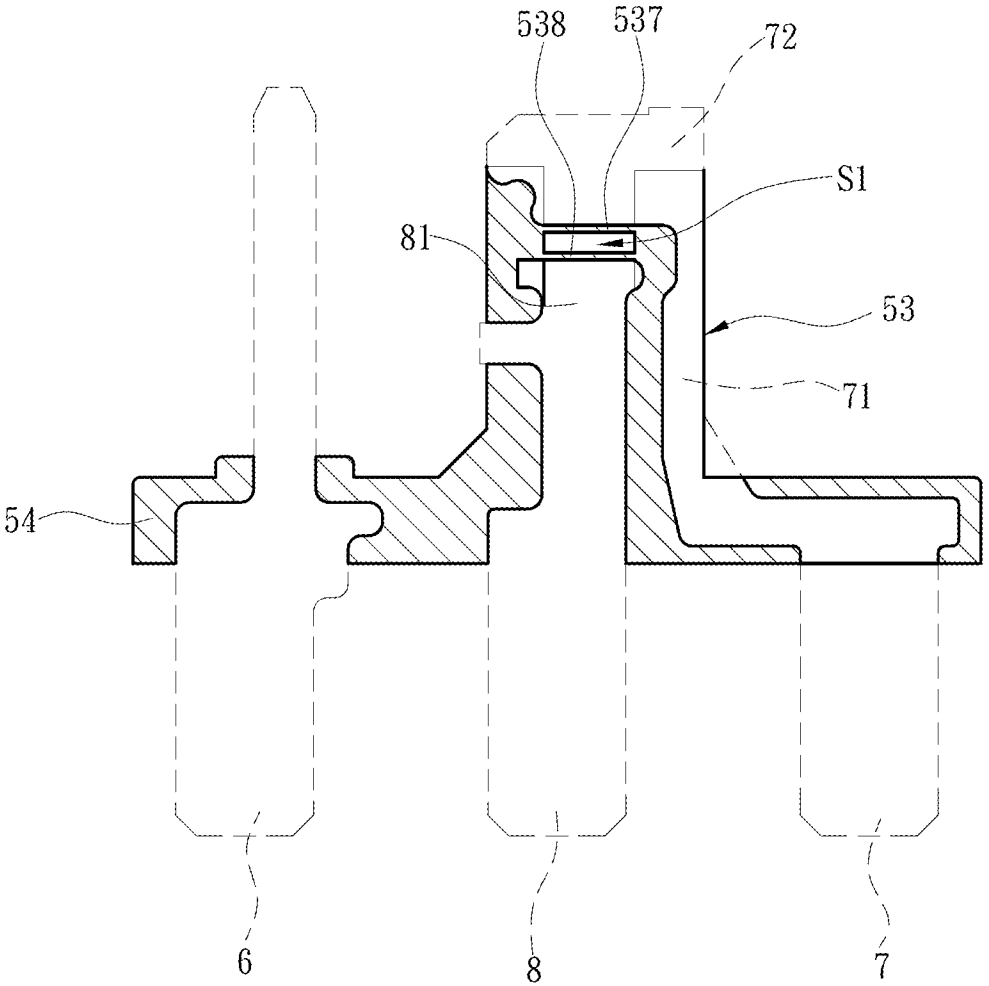
FIG. 7 is a sectional view of a base of a multi-instruction switch for enhancing electrical insulation of the present invention.

Referring to FIGS. 5A and 5B, in the present invention, the conductive elastic plate 52, when receiving a force of a user, performs a back-and-forth press process in the accommodating space 51. In the back-and-forth press process, the conductive elastic plate 52 has a released position when abutted by the restoration spring 57 while not receiving force, and a pressed position when being pressed. More specifically, the contact section 72 of the first pin 7 and the trigger section 81 of the second pin 8 are respectively at the released position of the conductive elastic plate 52 during the back-and-forth press process. That is to say, when the conductive elastic plate 52 is not pressed by force, the switching connection section 522 is in contact with the contact section 72, such that the common pin 6 becomes conducted to the first pin 7. When the conductive elastic plate 52 receives force and moves towards the pressed position, the switching connection section 522 disengages from the contact section 72, sequentially passes through the first insulation plate 537, the insulation space S1 and the second insulation plate 538, and comes in contact with the trigger section 81 of the second pin 8 to move to the pressed position, such that the common pin 6 becomes conducted to the second pin 8.

In the multi-instruction switch for enhancing electrical insulation of the present invention, the insulation effect is enhanced by the first insulation plate, the second insulation plate and the insulation space located at the limiting track. When the conductive elastic plate moves at the limiting track, the first insulation plate and the second insulation late are capable of cutting off unnecessary contact between the conductive elastic plate and the switching pin set, and the insulation space isolates the trigger section from the trigger section. Therefore, the present invention effectively enhances the electrical insulation capability of the switch.

In conclusion, the multi-instruction switch for enhancing electrical insulation of the present invention comprises a housing, a common pin and a switching pin set. The housing has an accommodating space, a conductive elastic plate disposed in the accommodating space, and a support rack disposed in the accommodating space and comprising a limiting track. The switching pin set, penetrating through the housing to extend into the accommodating space, comprises a first pin and a second pin disposed on the support rack. The first pin comprises a contact section located in the limiting track. The second pin comprises a trigger section located in the limiting track. The limiting track has an insulation space between the trigger section and the contact section. Thus, carbon residue generated during a switching process of the conductive elastic plate is not deposited between the contact section and the trigger section, such that the multi-instruction switch of the present invention can be applied to electronic devices having higher amperage.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A multi-instruction switch for enhancing electrical insulation, comprising:

a housing, comprising:

an accommodating space;

a conductive elastic plate, disposed in the accommodating space, performing a back-and-forth press process when receiving a user press, the conductive elastic plate comprising a normal connection section and a switching connection section; and a support rack, disposed in the accommodating space, the support rack comprising a limiting track for the switching connection section to move therein;

a common pin, penetrating through the housing to extend into the accommodating space, normally in electrical contact with the normal connection section; and a switching pin set, penetrating through the housing to extend into the accommodating space, the switching pin set comprising:

a first pin, disposed on the support rack, comprising a contact section located in the limiting track; and a second pin, comprising a trigger section located in the limiting track;

wherein, the limiting track comprises a first insulation plate disposed at the contact section and located between the contact section and the trigger section, a second insulation plate disposed at the trigger section and located between the contact section and the trigger section, and an insulation space located between the first insulation plate and the second insulation plate.

2. The multi-instruction switch of claim 1, wherein the support rack comprises a first support portion for fixing the first pin, and a second support portion for fixing the second pin.

3. The multi-instruction switch of claim 2, wherein the first support portion comprises a first embedding slot for embedding the first pin; the second support portion comprises a second embedding slot disposed correspondingly to the first embedding slot and for embedding the second pin.

4. The multi-instruction switch of claim 2, wherein the second support portion comprises an engaging slot for fixing the second pin.

5. The multi-instruction switch of claim 2, wherein the first pin includes a connection section embedded in the first support portion and connected to the contact section.

6. The multi-instruction switch of claim 2, wherein the first insulation plate is connected to the first support portion and the second support portion, and the second insulation plate is connected to the first support portion and the second support portion.

7. The multi-instruction switch of claim 6, wherein a thickness of the first insulation plate is greater than that of the contact section, and a thickness of the second insulation plate is greater than that of the trigger section.

8. The multi-instruction switch of claim 1, wherein the housing is formed by a base and a cover.

9. The multi-instruction switch of claim 1, wherein the housing comprises a press member assembled with the conductive elastic plate.

10. The multi-instruction switch of claim 9, wherein the press member comprises a flexible support member that deforms when receiving the user press during the back-and-forth press operation.

11. The multi-instruction switch of claim 1, wherein the housing comprises a restoration spring disposed in the accommodating space, accommodating around the common pin and connected to the conductive elastic plate.

* * * * *